US005323363A

United States Patent [19]

Hysek et al.

[11] Patent Number: 5,323,363

[45] Date of Patent: Jun. 21, 1994

[54] TIMEPIECE WITH SIMULTANEOUS TIME DISPLAY FOR AT LEAST TWO TIME ZONES

[75] Inventors: Jörg Hysek, Monaco; Philippe Subilia, Belmont S/Lausanne; François Bertouhd, Le Lieu, both of Switzerland

[73] Assignee: Tiffany and Company, New York, N.Y.

[21] Appl. No.: 78,976

[22] Filed: Jun. 17, 1993

[30] Foreign Application Priority Data

Jun. 18, 1992 [CH] Switzerland ..... 1921/92

[51] Int. Cl.[5] ..... G04B 19/22

[52] U.S. Cl. ..... 368/21; 368/27

[58] Field of Search ..... 368/21-27

[56] References Cited

U.S. PATENT DOCUMENTS

| | | | |
|---|---|---|---|
| 723,489 | 3/1903 | Rosenbusch . | |
| 3,513,653 | 5/1970 | Denardo . | |
| 3,633,354 | 1/1972 | Stemmler . | |
| 3,675,411 | 7/1972 | Sakuma . | |
| 4,634,287 | 1/1987 | Vuilleumier . | |
| 4,945,521 | 7/1990 | Klaus | 368/21 |

*Primary Examiner*—Vit W. Miska
*Attorney, Agent, or Firm*—Woodard, Emhardt, Naughton, Moriarty & McNett

[57] ABSTRACT

A timepiece for simultaneously indicating the time for at least two time zones, the timepiece comprising a watch movement; a dial, an hour indicating hand and a minute indicating hand, the hour indicating and minute indicating hands being mounted for rotating above the dial, for indicating the time for a first time zone; a first setting mechanism for the hands, first driving means for connecting the hour indicating and minute indicating hands to the watch movement, so as to rotate the hands for indicating the time over 12 hours; a first rotatable disc for indicating the time over 24 hours; second driving means for connecting the first rotatable disc to the watch movement, so as to rotate the disc of one revolution in 24 hours; a second rotatable disc for indicating the time zones; a second setting mechanism for the first and second rotatable discs, the mechanism comprising first setting means operable for setting the angular position of the first rotatable disc, independently of the rotation thereof by the second driving means, and second setting means operable for simultaneously setting the angular position of both the first rotatable disc and second rotatable disc, with an equal angular extent of rotation, wherein the first and second rotatable discs and the second setting mechanism for the discs are parts of a functional unit which is distinct from the watch movement.

14 Claims, 4 Drawing Sheets

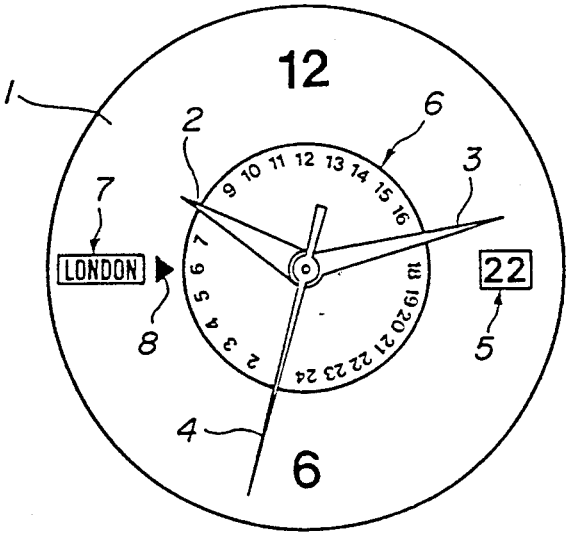
FIG. 1 (a)
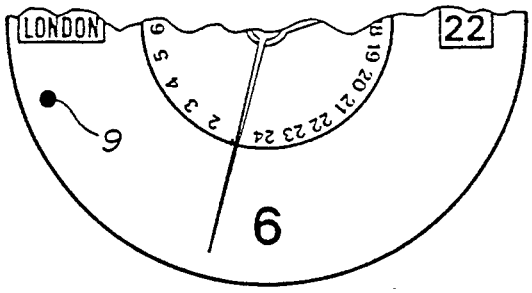
FIG. 1 (b)
FIG. 2
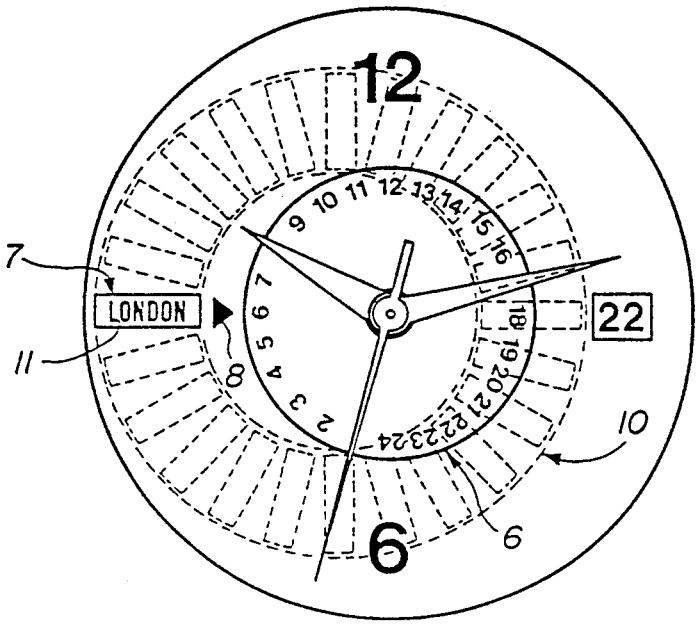

TIMEPIECE WITH SIMULTANEOUS TIME DISPLAY FOR AT LEAST TWO TIME ZONES

The invention relates to a timepiece for simultaneously indicating the time for at least two time zones.

A timepiece according to the invention may, for instance, be constructed in the form of a wrist watch, a pocket watch or, also, of a clock.

It is an object of the invention to provide a timepiece which allows a simultaneous time display for at least two different time zones, this result being achieved by using a purely mechanical device which has a simple and compact construction and, also, which is relatively inexpensive.

The above mentioned object is accomplished, in the timepiece according to the invention, in that this timepiece comprises a watch movement; a dial, an hour indicating hand and a minute indicating hand, said hour indicating and minute indicating hands being mounted for rotating above said dial, for indicating the time for a first time zone; a first setting mechanism for said hands, first driving means for connecting said hour indicating and minute indicating hands to said watch movement, so as to rotate said hands for indicating the time over 12 hours; a first rotatable disc for indicating the time over 24 hours; second driving means for connecting said first rotatable disc to said watch movement, so as to rotate said disc of one revolution in 24 hours; a second rotatable disc for indicating the time zones; a second setting mechanism for said first and second rotatable discs, said mechanism comprising first setting means operable for setting the angular position of said first rotatable disc, independently of the rotation thereof by said second driving means, and second setting means operable for simultaneously setting the angular position of both said first rotatable disc and second rotatable disc, with an equal angular extent of rotation, wherein said first and second rotatable discs and said second setting mechanism for said discs are parts of a functional unit which is distinct from the watch movement.

Further details, as well as related objects and advantages of the present invention will be apparent from the following description of illustrative embodiments of the invention, taken together with the accompanying drawings, in which:

FIG. 1(*a*) is a top view of a time display device forming part of a timepiece according to the invention;

FIG. 1(*b*) is a partial view of this same time display device, in another version thereof;

FIG. 2 is a top view of the device shown in FIG. 1(*a*), indicating in phantom the partial arrangement of this device;

Figure 3:
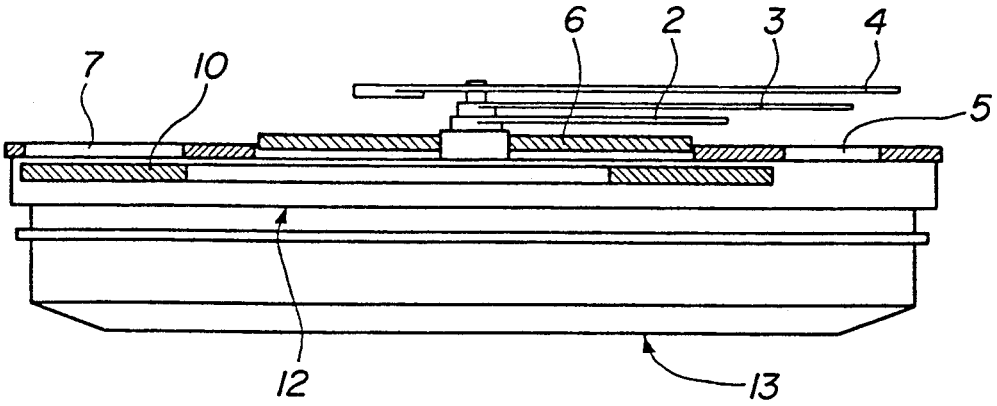
FIG. 3 is a schematic cross-sectional view of a timepiece including the display device illustrated in FIGS. 1 and 2.

The time display device shown in FIG. 1 comprise a dial 1 made as a circular plate of the usual type, the periphery of which carries the usual markings corresponding to the hours, of which only two, namely the numerals "6" and "12", are illustrated for sake of clarity of the drawing. The hands 2, 3 and 4 are driven by a watch movement (not illustrated) in the usual manner, so as to indicate, respectively, hours, minutes and seconds.

The dial 1 includes a first window 5 in which appears a numeral indicating the date inscribed on a rotating disc (non illustrated) placed beneath the dial 1, this disc being driven by the watch movement in a manner known per se.

The hands 2, 3 and 4 as well as the disc carrying the indication of the data can be operated in the usual manner when setting the time of the watch and changing the indication of date, by means of a mechanism operated by a lateral button (not illustrated).

In the middle of the dial 1, a circular opening receives a rotating disc 6 which bears the sequence of numerals ordered by increasing value from 1 to 24, these numerals being arranged circularly and evenly spaced apart angularly, in the present case by 15°. On the other hand, the dial 1 includes a window 7 in which appears an inscription identifying a town, for example "LONDON", as shown in FIG. 1.

A mark 8 consisting, in the present case, of a triangular inscription on the dial 1, is placed opposite the window 7, with one of the corners of the triangle pointing towards the disc 6. This enables the identification of a numeral inscribed on the disc 6 (in the present case, the numeral "6") which faces the mark 8, and therefore the window 7 when reading the time.

The 24 numerals inscribed on the disc 6 correspond each to the time in one of the 24 time zones and the disc 6 is constructed in such a manner as to be driven by the watch movement, synchronically with the hour-hand 2, one full revolution of disc 6 corresponding to two full revolutions of the hour-hand, i.e. one full revolution of the disc 6 requiring 24 hours. In the remainder of the description, disc 6 will be designated by the term "24-hour disc".

FIG. 1(*b*) shows another version of the device of FIG. 1(*a*) having, in addition to the components described above, a small circular opening 9 in the dial 1, which allows an indication to appear, consisting of a color contrasting with that of the dial around this opening (for example, a red indication when the dial is white), when the legislation of the country where the town lies, the name of which appears in the window 7, stipulates that time be changed at specific dates (for example in the case of summer hours different from the winter hours).

As can be seen in FIG. 2, the inscription appearing in the window 7 of the dial 1 is located on a peripheral surface part 11 of a disc 10 lying parallel to the dial 1 and beneath the same, with its center being offset with respect to that of the 24-hour disc 6.

Disc 10 is arranged in such a manner as to be rotatable around an axis extending through its center and running parallel to the axis of the hands 2, 3 and 4 of the 24-hour disc 6, so as to allow one inscription of a series of 24 inscriptions identifying one of the towns of one of the 24 time zones to appear in the window 7, these inscriptions being arranged in the same order as the time zones and each one being located in one of the 24 parts 11 of the surface of the disc such as mentioned above. Disc 10 will be designated in the remainder of the description by the term "time zone disc".

Means, not shown in FIGS. 1 and 2, make it possible to rotate simultaneously both discs 6 and 10 with the same angular displacement. Thus, when one rotates the disc 10 to replace one inscription identifying a time zone, e.g. by the name of a representative town appearing in the window 7 by an inscription identifying another time zone by the name of a corresponding town or representative place, the 24-hour disc 6 is also simultaneously driven in rotation by an angle of rotation identical to the angular distance between these two inscriptions of the time zone disc 10.

The setting mechanism of discs 6 and 10 is further constructed in such a manner as to allow two different types of operations, namely:

1) the simultaneous rotation of the time zone disc 10 and the 24-hour disc 6;
2) the rotation of solely the 24-hour disc 6.

It should be noted that the setting mechanism of discs 6 and 10 and the means for allowing the 24-hour disc 6 to be driven by the watch movement are, as indicated above, arranged in such a manner that solely the 24-hour disc 6 is driven in rotation by the watch movement, this driving proceeding independently of the rotation imparted thereto through one of the above mentioned operations 1) and 2).

As can be seen in FIG. 3, the 24-hour disc 6 is placed in a central opening of the dial 1 with its upper surface slightly above the plane of the upper surface of this dial. Conversely, the time zone disc 10 is placed beneath the dial 1, an inscription identifying a town being positioned facing the window 7 and beneath it, so that it may be read.

The assembly of the two discs 6 and 10 as well as the setting mechanism for these discs form a functional unit or module 12, which is distinct from the watch movement. The latter is simply designated generally by the reference numeral 13 in FIG. 3 without showing any details of the construction of this watch movement.

The manner in which the device described above is used, i.e. the method for using this device according to the invention, will now be described:

1) Initial setting of the watch on time a) Firstly, the position of the hands 2 and 3 indicating, respectively, hours and minutes, is adjusted in the usual manner so as to indicate the time corresponding to the time zone in which one is or, should the need arise, corresponding to another time zone, freely selected (for example, of a town to which one is to travel and where the watch is to be subsequently used). In both cases, the time zone thus selected will be designated by the term "local time zone".

In order to carry out this adjustment, one operates a setting mechanism of the usual type for rotating the hands, this mechanism being, for example, actuated by a button protruding laterally at the periphery of the watch casing, in a manner known per se.

b) Thereafter, the time zone disc 10 is operated in such a manner as to display the name of the town corresponding to the local time zone (for instance, a town having a 4-hour advance on Greenwich mean time).

In this operation, the 24-hour disc 6 is also driven in rotation synchronically with the time zone disc 10, but the time indicated by the numeral of the 24-hour disc 6 opposite the mark 8 after the rotation of the time zone disc 10 generally does not correspond to the time indicated by the hour-hand 2.

c) In such a case, the two indications of time should be made to correspond, which is achieved by operating solely the 24-hour disc 6, in such a manner that the numeral coming opposite the mark 8 correspond to the time indicated by the hand 2. One has of course to take into account whether the time indicated on the dial 1 by the hand 2 is a morning time or an afternoon time ("ante meridiem" or "post meridiem"). For instance, the indication "10 o'clock" can correspond either to 10 o'clock in the morning (10 a.m.) which is indicated by the numeral 10 on disc 6, or to 10 o'clock in the evening (10 p.m.) which is indicated by the numeral 22 on disc 6.

After the latter operation, the initial time setting operation (initialization") is completed, and local time is then given simultaneously by the hour-hand 2 of the main dial 1 and by the numeral of the 24-hour disc 6 opposite the mark 8.

2) The simultaneous display of the local time and of the time corresponding to a time zone different from the local time zone One only needs to operate the time zone disc 10, in the same manner as in the above mentioned operation 1(*b*), to display the name of the town corresponding to any time zone in which one wishes to know the time (for example "LONDON" in the case illustrated in FIGS. 1 and 2), and the numeral of the 24-hour disc 6 indicating the time corresponding to this time zone will come opposite the mark 8.

Thus, in the case illustrated in FIGS. 1 and 2, one can read that time is 9 o'clock in London, while local time is 10 o'clock.

Evidently, the simultaneous operation of the time zone disc 10 and of the 24-hour disc 6 until the numeral "10" of the latter comes opposite the mark 8 would cause the name of the town corresponding to the local time zone to appear again in the window 7.

When the time zone disc 10 is not operated at all, i.e. when maintaining unchanged the display of a town corresponding to a given time zone (e.g. "LONDON"), the 24-hour disc 6 is driven by the watch movement synchronically with the hour-hand 2, so that at any moment, the local time and the time corresponding to a time zone generally different from the local time zone are displayed simultaneously.

In the particular case where the name of the town displayed corresponds to the local time zone, the local time of course is displayed twice, which could offer some advantage in that the numeral of the 24-hour disc 6 opposite the mark 8 indicates unequivocally whether it is morning or afternoon.

The actuation of the setting mechanism of the time zone disc 10 and of the 24-hour disc 6 can be advantageously achieved by acting upon appropriate separate members, depending on whether the operation described above in section 1(*b*) (simultaneous rotational drive of disc 10 and of disc 6) or that described in section 1(*c*) (rotational drive of the sole disc 6) is to be carried out.

For instance, these two members can consist of a push-button protruding laterally from the periphery of the casing for the operation of section 1(*b*) and of a push-button placed in a recess provided laterally on the casing for the operation of section 1(*c*), these two members being advantageously located symmetrically with respect to the button of the watch (e.g. when this button is positioned at "3 o'clock" on the watch, said protruding push-button can be positioned at "2 o'clock" and the recessed push-button can be positioned at "4 o'clock").

Advantageously, the actuating mechanism which makes possible the operation 1(*b*) and the operation 1(*c*) respectively, is arranged in such a manner that these operations can be carried out in a stepwise mode (with a discrete transition from one inscription to the following for the time zone disc 10 and from one numeral to the following for the 24-hour disc 6).

Figure 4:
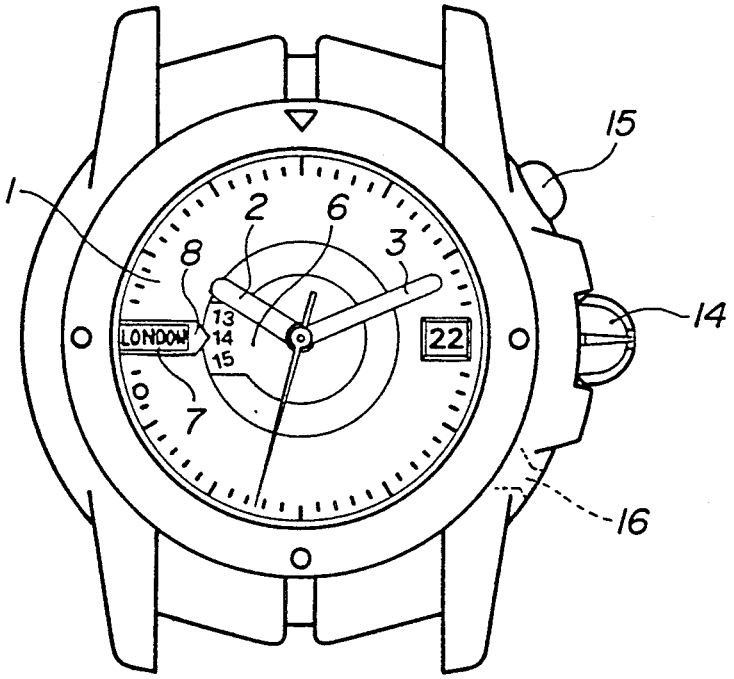
FIG. 4 is a front view of a timepiece, according to another embodiment of the invention.

FIG. 4 illustrates a watch with a dial 1 giving the local time by means of a hour-hand 2 and of a minute-hand 3.

The town corresponding to the time zone, of which one wishes to know the time, is indicated by an inscription (in the present case, "LONDON") appearing through the window 7 and the corresponding time is indicated by the numeral (in the present case "14") appearing on the 24-hour disc 6 opposite the mark 8 of the dial 1, opposite the inner edge of the window 7.

In the particular case illustrated in FIG. 4, only three numerals inscribed on the 24-hour disc 6 appear through a central opening of the dial 1, namely the numeral "14" indicating the hour in the time zone in which is located the town displayed in window 7, the preceding numeral, namely "13", and the following numeral, namely "15".

A button 14 positioned at "3 o'clock" makes it possible to rotate the hands 2 and 3 in a conventional manner, for setting the watch on time and also for rewinding the watch movement in the case of the latter being mechanical.

A push-button 15 at "2 o'clock" makes possible the simultaneous and stepwise change of the time zone display and of the time over 24 hours (operation described in section 1(*b*) above) and another push-button 16 at "4 o'clock" makes possible the stepwise rotation of solely the 24-hour disc (operation of section 1(*b*). In accordance with the embodiment shown in FIG. 4, the push-button 16 is placed at the bottom of a recess provided on the watch casing and its position is therefore indicated in phantom. It can be operated, for example, by the tip of a ball point pen, in a manner known per se. Evidently, the push-button 16 could also be protruding, in a manner similar to that of the push-button 15.

Figure 5:
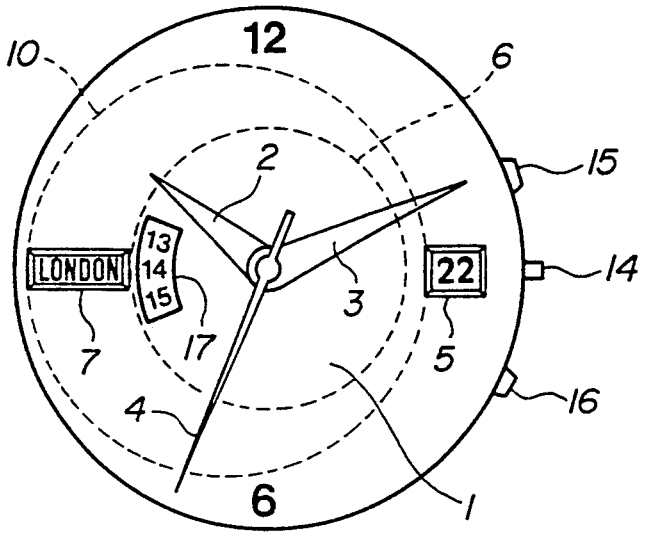
FIG. 5 is a plan view of a time display device according to yet another embodiment of the timepiece of the invention.

The display device shown in FIG. 5 is similar to that of the watch member of FIG. 4, except that the three inscriptions visible of the 24-hour disc 6 (the position of which beneath the dial 1 is indicated inphantom as a circle) appear in the window 17, the central part of the 24-hour disc being hidden by the central part of the dial 1. The position of the time zone disc 10, beneath the dial 1, is also indicated in phantom as a circle.

Figure 6:
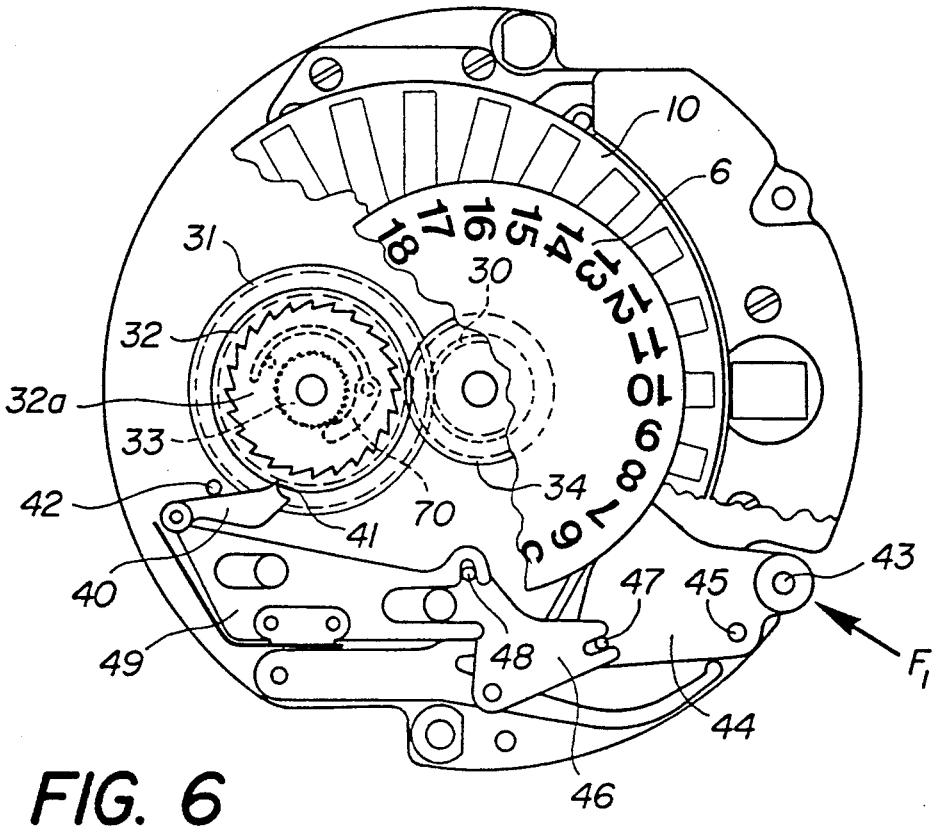
FIG. 6 is a plan view of a particular embodiment of a time display mechanism for a timepiece according to the invention, this view showing more particularly in a schematic manner the arrangement of the driving means and of the setting means for the first rotatable disc (24-hour disc)

The mechanism shown in FIG. 6 comprises a gear wheel 30 continuously driven synchronically with the hour-hand by the watch movement (not illustrated) and this mechanically driven wheel hence turns by a full revolution in 12 hours in the clockwise direction.

The wheel 30 is engaged with a gear wheel 31 having twice as many teeth as wheel 30 and accomplishing therefore a full revolution in 24 hours in the anticlockwise direction. The wheel 31 drives a wheel 32 disposed coaxially therewith, via a mechanism including a ratchet wheel 33 which is also coaxial with the wheels 31 and 32 and which cooperates with a pawl member 70, which is elastically urged against it, so as to engage in rotation the wheels 31 and 32 in the direction of rotation of the wheel 31 (i.e. anticlockwise), while making it possible to operate in rotation the wheel 32, again anticlockwise, independently of its driving by the wheel 31.

The wheel 32 acts as an intermediate gear wheel which turns by a full revolution in 24 hours and which is engaged with a gear wheel 34 having the same number of teeth and mounted coaxially with respect to the wheel 30, and therefore also with respect to the hands of the watch member, but without being driven directly by the watch movement (i.e. the axis of the wheel 34 is mounted idle coaxially with that of the wheel 30).

The wheel 34 performs therefore a full revolution in 24 hours in the clockwise direction, but can also be driven in rotation, again in the clockwise direction but independently of said permanent rotation, by the above mentioned transmission of a rotary motion of the wheel 32.

This operating motion can be imparted to the wheel 32 by an operating part 40 provided with a finger 41 which acts upon the teeth forming part of a series of 24 ratchet teeth cut out along the periphery of a disc 32*a* rigidly locked with the wheel 32 and superimposed upon the same (the wheel 32 and the disc 32*a* can possibly be made integral). The wheel 34 is locked in rotation with the 24-hour disc 6.

The operating part 40 is itself actuated in such a manner as to undergo a translatory motion by sliding against a guide pin 42 in the direction indicated by an arrow in FIG. 6, by acting in the direction of the arrow $F_1$ upon a pusher means 43 forming part of a pivoting part 44 consisting of a plate capable of rotating in its plane around an axis 45, as indicated also by an arrow. The motion of the part 44 is transmitted to an intermediate pivoting part 46 by means of a pin 47 protruding from the surface of the part 44. This pivoting intermediate part 46 drives, through a pin 48, a second intermediate part 49, capable of a translatory motion in the direction indicated by an arrow, hinged at the rear of the operating part 40. Resilient pull back means, on which we shall elaborate later in the present description, make it possible to produce a backward return of the whole of the parts 44, 46, 49 and 40, after each application of pressure on the pusher means 43, so that the operation of wheel 32 proceeds in a stepwise mode at each application of a pressure of finger 41 against one tooth of the disc 32*a*. Since the wheel 34 is locked in rotation with the 24-hour 6 as mentioned previously, each application of pressure against the pusher means 43 results in the clockwise displacement of the disc 6 by 1/24th of a full revolution.

Figure 7:
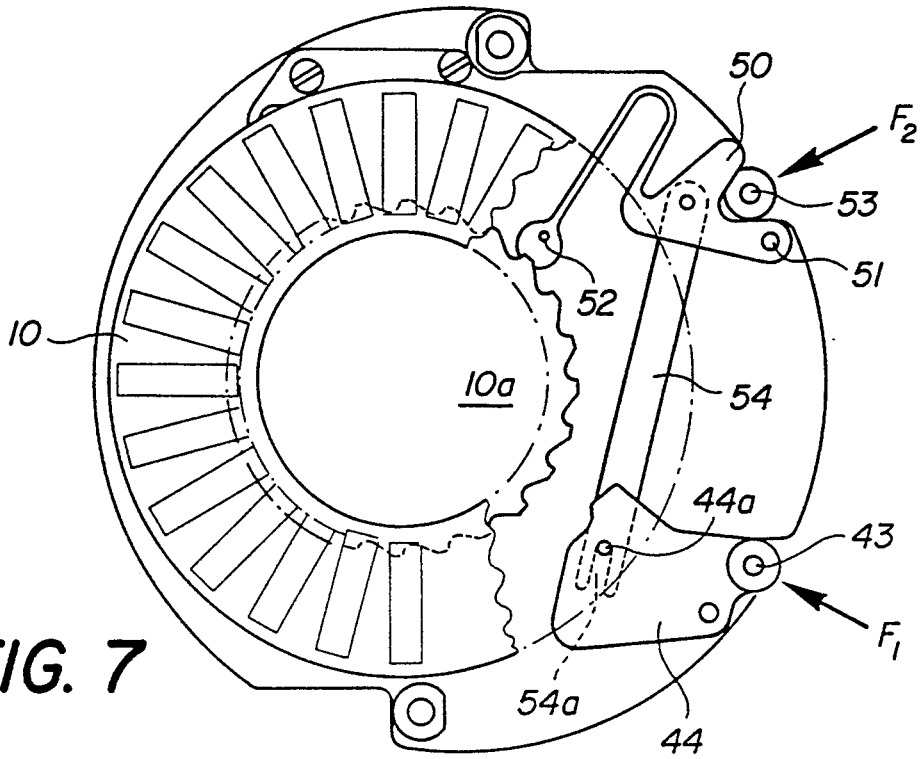
FIG. 7 is a plan view of the same time display mechanism as shown in FIG. 6, illustrating more particularly, in a schematic manner, a part of the arrangement of the setting means for the simultaneous operation of the first and second rotatable discs.

We shall now describe, with reference to FIG. 7, the arrangement of the means which make possible the simultaneous rotation of the time zone disc 10 and of the 24-hour disc 6.

A pivoting part 50, consisting in substance of an elongate plate capable of a rotational motion in its plane around an axis 51, located in the vicinity of one of its ends, is provided in the vicinity of the other end with a pin 52 protruding perpendicularly with respect to the plane of part 50.

The operation of the pivoting part 50 is ensured by the application of a pressure in the direction of arrow $F_2$ against a pusher means 53, the effect of which is to displace, in the direction indicated by an arrow, the end of the part 50 carrying the pin 52.

The pin 52 then presses against a tooth forming part of a series of 24 ratchet teeth cut out on the periphery of a disc 10*a* locked in rotation with the time zone disc 10 (the discs 10*a* and 10 can possibly be made integral).

A resilient pull-back means, on which we shall elaborate later in the description, makes possible the backward pivoting of the part 50 after each application of pressure on the pusher member 53. Thus, the operation of the disc 10*a* proceeds in a stepwise mode, each application of pressure of pin 52 against one of the 24 teeth of the disc 10*a* provoking the displacement of the disc 10 by 1/24th of a full revolution, in the clockwise direction.

A connecting part 54, elongate and rectilinear, hinged to the pivoting part 50, makes it possible to transmit to the pivoting part 44 the motion of part 50, when the latter rotates in the direction corresponding to the direction of operation of disc 10.

The connection between the part 44 and the end of the connecting part 54 opposite to that which is hinged to the pivoting part 50, is ensured by a pusher 44*a* protruding from the surface of the pivoting part 44, sliding in a groove 54*a* provided at the end of part 54.

Accordingly, while the pivoting motion of part 50 obtained by the application of a pressure on the pusher member 53 in the direction of the arrow $F_2$ for the operation of the time zone disc 10 always results in the pivoting of the part 44 in such a manner that the 24-hour disc 6 be also operated, in the manner described above with reference to FIG. 6, the application of pressure on the pusher émember 43 in the direction of the arrow $F_1$ makes it possible to rotate solely the part 44, without any effect on part 50.

One will hence understand that the application of a pressure on the member 53 in the direction of arrow $F_2$ makes it possible to achieve the simultaneous operation of the time zone disc 10 and of the 24-hour disc 6, whilst the application of pressure on the member 43 in the direction of arrow $F_1$ makes it possible to operate solely the 24-hour disc (6).

Figure 8:
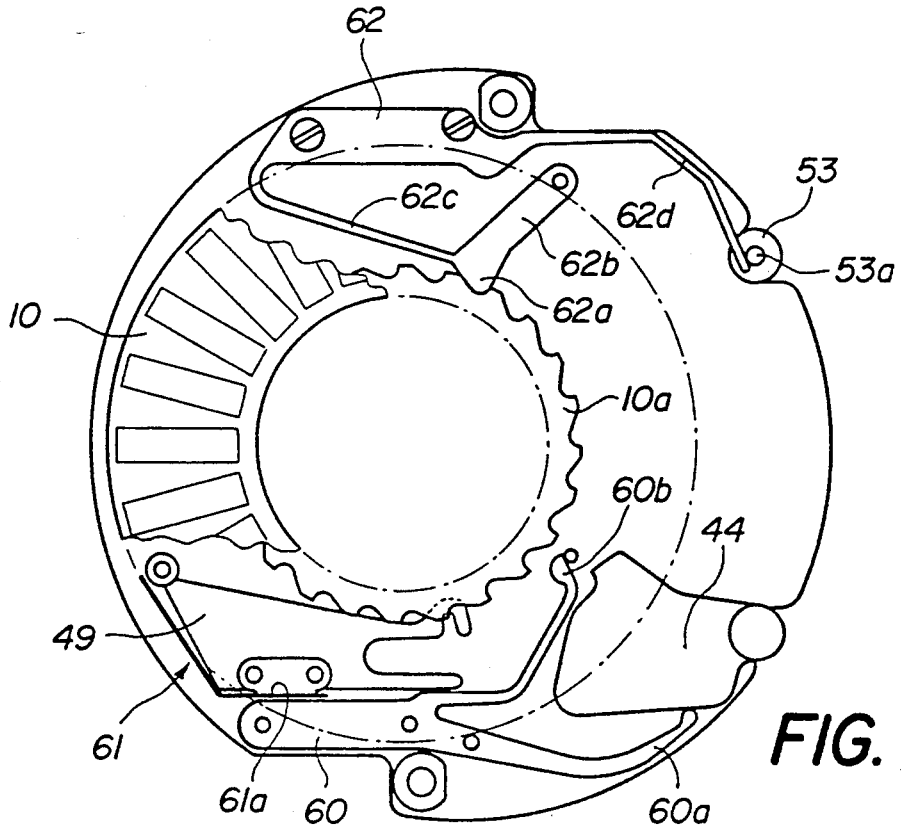
FIG. 8 is a plan view of the same mechanism as that shown in FIGS. 6 and 7, illustrating more particularly, in a schematic manner, the arrangement of elastic biasing means associated with the driving and setting means shown in said figures.

The above mentioned resilient pull-back means ensure the return backwards of the mobile parts operating the discs 6 and 10 are shown in a particularly explicit manner in FIG. 8, which also shows a ratchet mechanism directed at retaining the ratchet teeth of disc 10*a*.

Specifically, the pulling back of the pivoting part 44 is obtained by the means of a first resilient arm 60*a* of a member 60 further exhibiting a second resilient arm 60*b* which acts as a stopper to limit the pivoting of the part 44 when the 24-hour disc 6 is operated. Further, the intermediate part 49 associated with the part 44 is also pulled back by means of V-shaped spring 61, one side 61*a* of which is attached to the part 49.

The ratchet device for preventing the rotation in the anticlockwise direction of the teeth of the disc 10*a* consists of a heel 62*a* of a foot 62*b*, placed at the end of a resilient leg 62*c* of a member 62 further exhibiting a resilient arm 62*d* designed for pulling back the pivoting part 50, through the application of pressure on a pin 63*a* protruding from the member 53.

The mechanism which has been described above can be constructed as a thin module (having, for example, a thickness in the order of 1.5 to 3 mm), separates from the watch movement.

Those skilled in the art will readily recognize that modifications can be made on the above described watch member without departing from the spirit of the invention.

In particular, the means for indicating time could be arranged in such a manner that two or more inscriptions of the time zone disc appear simultaneously, at the same time as the same number of corresponding inscriptions of the 24-hour disc. This would enable the simultaneous indication, in addition to the time in a first time zone, of the time in two other time zones or more, and not only in a second time zone.

We claim:

1. A timepiece for simultaneously indicating the time for at least two time zones, said timepiece comprising a watch movement; a dial, an hour indicating hand and a minute indicating hand, said hour indicating and minute indicating hands being mounted for rotating above said dial, for indicating the time for a first time zone; a first setting mechanism for said hands; first driving means for connecting said hour indicating and minute indicating hands to said watch movement, so as to rotate said hands for indicating the time over 12 hours; a first rotatable disc for indicating the time over 24 hours; second driving means for connecting said first rotatable disc to said watch movement, so as to rotate said disc of one revolution in 24 hours; a second rotatable disc for indicating the time zones; a second setting mechanism for said first and second rotatable discs, said mechanism comprising first setting means operable for setting the angular position of said first rotatable disc, independently of the rotation thereof by said second driving means, and second setting means operable for simultaneously setting the angular position of both said first rotatable disc and second rotatable disc, with an equal angular extent of rotation, wherein said first and second rotatable discs and said second setting mechanism for said discs are parts of a functional unit which is distinct from the watch movement, and wherein said second driving means comprise a first wheel, which serves as a permanent torque transmission member, driven in synchronism with said hour indicating hand, said first wheel being engaged with a second wheel which has a number of teeth the double of that of the teeth number of the first wheel, said second wheel being mounted coaxially with a third wheel and said third wheel being driven by said second wheel through a driving mechanism which allows said third wheel to be freely rotated in the same direction as said second wheel, said third wheel being engaged with, and serving as a transmission wheel of rotation of one revolution in 24 hours for a fourth wheel which is mounted as an idle-wheel coaxially with said first wheel, said fourth wheel being also coaxial with said first disc and rotating as an integral part thereof.

2. A timepiece as defined in claim 1, wherein said driving mechanism for allowing said third wheel to be driven by said second wheel comprises a ratchet-wheel which is coaxial with, and an integral part of, said third wheel, and a pawl member which is elastically urged against said ratchet-wheel and is an integral part of said second wheel.

3. A timepiece as defined in claim 1, wherein said first setting means of said second setting mechanism for said rotatable discs are arranged so as to allow said first disc to be rotated in steps of an angular extent of 1/24 revolution, and second setting means of said second setting mechanism are arranged so as to allow said second disc to be rotated in steps having also an angular extent of 1/24 revolution, said second setting means being coupled with said first setting means so that the operating of the second setting means necessarily brings about simultaneous operating of the first setting means, whereas separate operating of the first setting means has no effect on the second setting means.

4. A timepiece as defined in claim 3, wherein said first setting means comprise a first actuating member having a finger which is arranged so as to give a push to one tooth of a series of 24 teeth provided around the periphery of a fifth wheel which is coaxial with, and rotated as an integral part of said third wheel, and a first actuating mechanism for acting on said first actuating member so as to rotate said first disc, and said second setting means comprise a second actuating member having a stop-pin which is arranged so as to give a push to a tooth of a series of 24 teeth provided around the periphery of a third disc which is rotated as an integral part of said second disc, and a second actuating mechanism for acting on said second actuating member so as to rotate said second disc, said second actuating mechanism for said second actuating member being coupled with said first actuating mechanism for said first actuating member so that each operating of said second actuating member necessarily brings about a simultaneous operating of said first actuating member, whereas a separate operating of said first actuating member can be effected, without action on said second actuating mechanism, by direct action on said first actuating mechanism.

5. A timepiece as defined in claim 4, wherein said first actuating mechanism for said first actuating member comprises a first pivoting member having a first push-button, a second pivoting member and an intermediary member which is movable in translation, said members cooperating together and with said first actuating member so that a pushing movement on push button, which brings about a pivoting of first pivoting member, is transmitted to said first actuating member and brings about a translation thereof so that said finger acts on said fifth wheel and imparts thereto a rotation with an angular extent of 1/24 revolution.

6. A timepiece as defined in claim 4, wherein said second actuating mechanism comprises a push button.

7. A timepiece as defined in claim 3, wherein said second setting mechanism further comprises first elastic biasing means for bringing back to their initial position the movable parts of said first setting means, and second elastic biasing means for bringing back to their initial position the movable parts of said second setting means.

8. A timepiece as defined in claim 7, wherein said first elastic biasing means comprise a blade-shaped member having a first resilient arm urging said first pivoting member back to its initial position, and a second resilient arm which acts as a stop member for limiting the pivoting amplitude of said first pivoting member, and a bent spring which is mounted on said intermediary member and urges it back to its initial position.

9. A timepiece as defined in claim 7, wherein said second elastic biasing means comprise a blade-shaped member having a resilient arm which urges said second actuating member back to its initial position.

10. A timepiece as defined in claim 4, wherein said second setting mechanism for the discs comprises a ratchet-and-pawl mechanism which is arranged so as to maintain said second disc in a fixed position after each rotation step thereof.

11. A timepiece as defined in claim 10, wherein said ratchet-and-pawl mechanism comprises a heel which is part of a foot located at the end of an elastic leg of a blade-shaped member comprising said second elastic biasing means.

12. A timepiece as defined in claim 4, wherein said second setting mechanism further comprises first elastic biasing means for bringing back to their initial position the movable parts of said first setting means, and second elastic biasing means for bringing back to their initial position the movable parts of said second setting means.

13. A timepiece as defined in claim 5, wherein said second setting mechanism further comprises first elastic biasing means for bringing back to their initial position the movable parts of said first setting means, and second elastic biasing means for bringing back to their initial position the movable parts of said second setting means.

14. A timepiece as defined in claim 6, wherein said second setting mechanism further comprises first elastic biasing means for bringing back to their initial position the movable parts of said first setting means, and second elastic biasing means for bringing back to their initial position the movable parts of said second setting means.

* * * * *

UNITED STATES PATENT AND TRADEMARK OFFICE

CERTIFICATE OF CORRECTION

PATENT NO. : 5,323,363

DATED : June 21, 1994

INVENTOR(S) : Jorg Hysek, et al.

It is certified that error appears in the above-indentified patent and that said Letters Patent is hereby corrected as shown below:

In Col. 2, at line 26, delete "data" and substitute --date--.

Signed and Sealed this

Seventh Day of February, 1995

Bruce Lehman

*Attest:*

BRUCE LEHMAN

*Attesting Officer*

*Commissioner of Patents and Trademarks*